US005541821A

United States Patent [19]

Murakami

[11] Patent Number: 5,541,821

[45] Date of Patent: Jul. 30, 1996

[54] VEHICULAR LAMP

[75] Inventor: Tomokazu Murakami, Shizuoka, Japan

[73] Assignee: Koito Manufacturing Co., Ltd., Tokyo, Japan

[21] Appl. No.: 299,127

[22] Filed: Sep. 2, 1994

[30] Foreign Application Priority Data

Sep. 3, 1993 [JP] Japan ..... 5-052619 U

[51] Int. Cl.[6] ..... F21V 29/00

[52] U.S. Cl. ..... 362/294; 362/61; 362/345

[58] Field of Search ..... 362/61, 294, 226, 362/307, 310, 296, 345, 373

[56] References Cited

U.S. PATENT DOCUMENTS 4,412,276 10/1983 Blinow ..... 362/310 X 4,744,011 5/1988 Tomita et al. ..... 362/80

4,937,710 6/1990 Hurley et al. ..... 362/61

5,084,805 1/1992 Goto ..... 362/61

*Primary Examiner*—Stephen F. Husar

*Attorney, Agent, or Firm*—Sughrue, Mion, Zinn, Macpeak & Seas

[57] ABSTRACT

A vehicular lamp having a rear wall constituting an effective reflecting surface and peripheral walls. A bulb mounting hole and a vent are formed on the peripheral walls so that the entire area of the effective reflecting surface can be utilized as a reflecting surface, thereby improving the reflection efficiency of light and the outward appearance of the lamp, while allowing the lamp to be constructed with a slim body.

15 Claims, 3 Drawing Sheets

VEHICULAR LAMP

BACKGROUND OF THE INVENTION

The present invention relates generally to a vehicular lamp, and more particularly to a vehicular lamp having an improved light emission efficiency, while having a reduced size and slim body.

FIG. 4 is a sectional view showing a conventional vehicular lamp. The lamp is provided with a resin-molded lamp body 101 constituted by peripheral walls 111 in a rectangular frame shape and a parabolic-shaped rear wall 112 molded unitarily with the peripheral walls 111 at the rear side thereof. Inner surfaces of the lamp body 101 are coated with aluminum or the like to provide a reflective surface, and an opening is formed in the rear wall 112 to constitute a bulb mounting hole 113 into which a bulb socket 103 is fitted to mount a bulb 104 inside the lamp body 101. A transparent front lens 102 is integrally secured over a front opening of the lamp body 101.

The vehicular lamp is also provided with a vent 114 in the rear wall 112 so that the interior of the lamp body 101 is ventilated, thereby to avoid undesirable condensation and accumulation of moisture on the inner side surfaces of the lamp body 101. Generally, the vent 114 is defined by a cylindrical member extending to the outside from the lamp body, and capped with a cover tube 115.

In a conventional lamp body formed by resin molding, the bulb mounting hole 113 and vent 114 extend in the direction in which the molded product is extracted from the mold die in order to simplify the structure of the mold dies and to allow for the easy removal of the lamp body from the mold. Because the removal direction of the lamp body 101 (indicated by arrows Y in FIG. 4) is in the front-rear direction of the lamp, the bulb mounting hole 113 and the vent 114 are formed on the rear wall 112 of the body 101.

If the vehicular lamp is generally rectangular in shape, the inner surface of the parabolic-shaped rear wall 112 must provide the entire effective reflecting surface 116 used to obtain the desired light distribution pattern. Accordingly, the conventional lamp, where the bulb mounting hole 113 and vent 114 occupy a part of the rear wall 112 as shown in FIG. 4, suffers from a problem in that the area of the effective reflecting surface 116 is reduced, and the reflection efficiency of light emitted from the bulb 104 reduced, as a result of which the light distribution characteristics of the lamp are deteriorated.

Moreover, when such a lamp is viewed from the front of the vehicle, the bulb socket 103 fitted in the bulb mounting hole 113 and vent 114, both disposed on the effective reflecting surface 116, can be observed through the front lens 102 as black shadows. This deteriorates the outward appearance of the lamp.

Further, since the bulb socket 103 and the cylindrical member and cover tube 115 of the vent 114 protrude rearward from the rear wall 112 of the lamp body 101, a compact and slim lamp cannot be obtained.

SUMMARY OF THE INVENTION

The present invention was made in view of the foregoing problems accompanying the conventional vehicular lamp. Accordingly, an object of the invention is to provide a vehicular lamp having improved light distribution characteristics.

Another object of the invention is to provide a vehicular lamp having a good outward appearance.

It is another object of the invention to provide a vehicular lamp compact in size and having slim body.

The above and other objects can be achieved by the provision of a vehicular lamp which, according to the present invention, includes a bulb mounting hole and a vent formed on a surface other than the effective reflecting surface of the lamp body.

DESCRIPTION OF THE PREFERRED EMBODIMENTS

Figure 1:
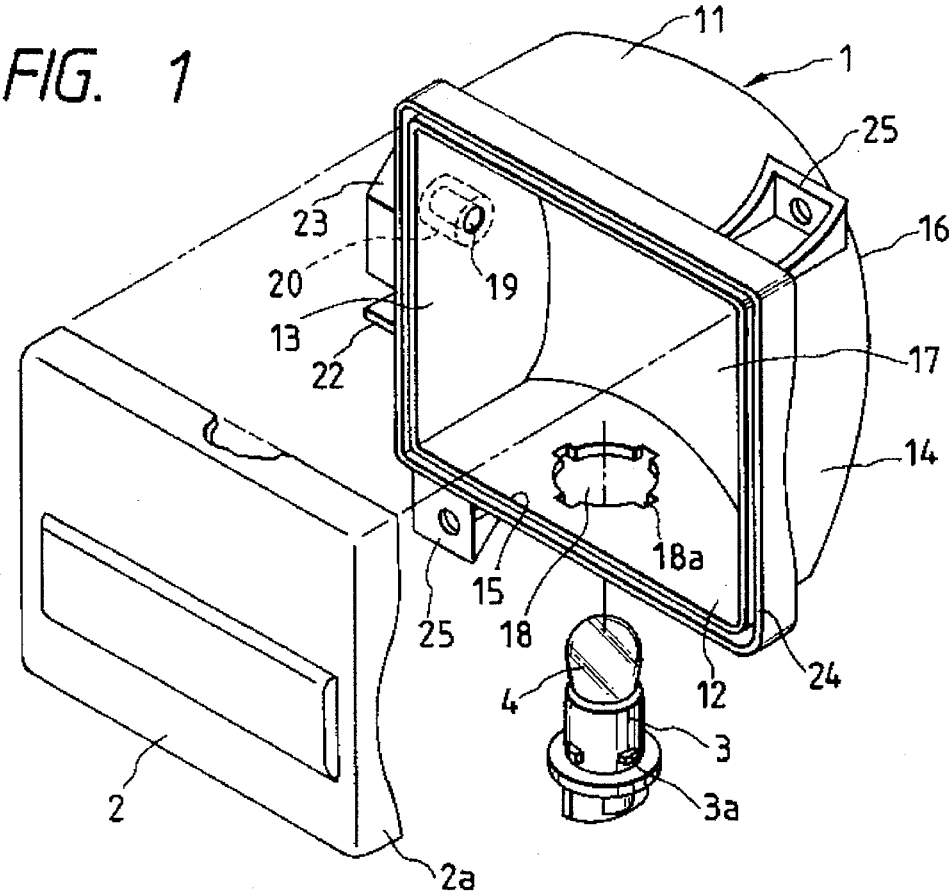
FIG. 1 is a perspective view showing a vehicular lamp constructed in accordance with the present invention in the form of a back-up lamp for a motor vehicle.
Figure 4:
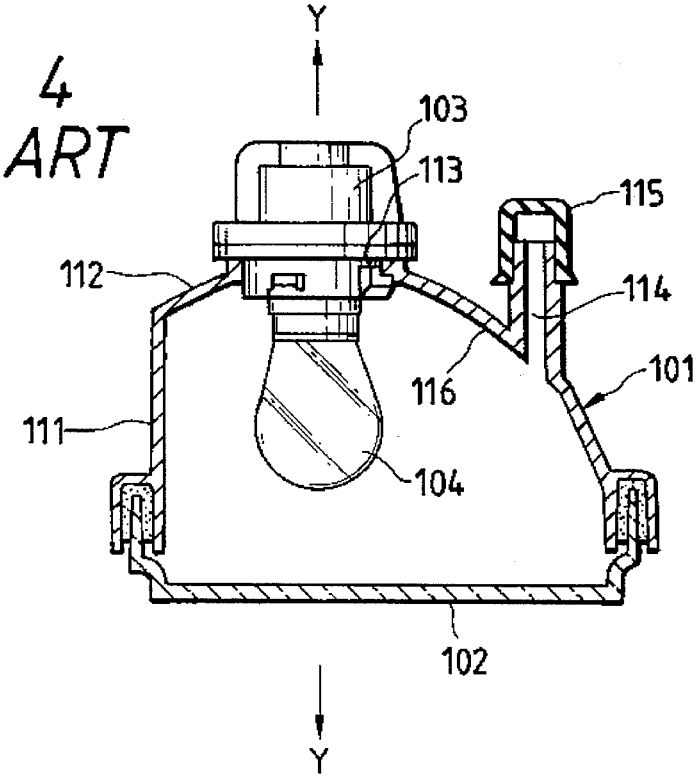
FIG. 4 PRIOR ART
FIG. 4 is a plane sectional view of a conventional lamp.
Figure 2A:
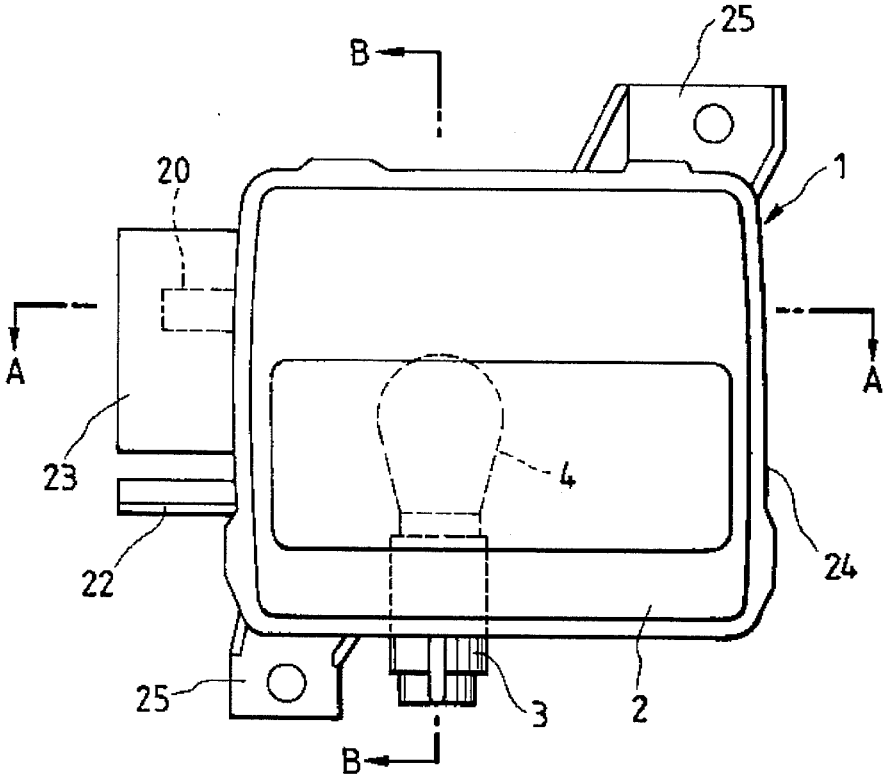
FIG. 2A is a front view of the lamp shown in FIG. 1.
Figure 2B:
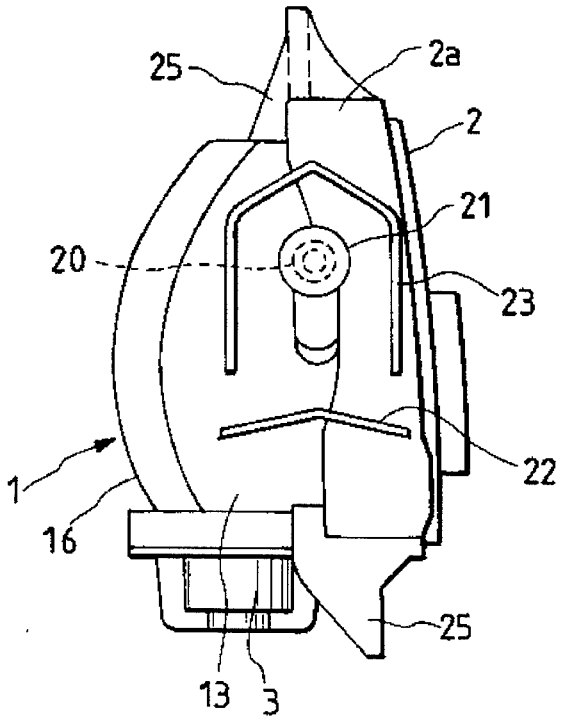
FIG. 2B is a left side view of the lamp shown in FIG. 1.
Figure 3A:
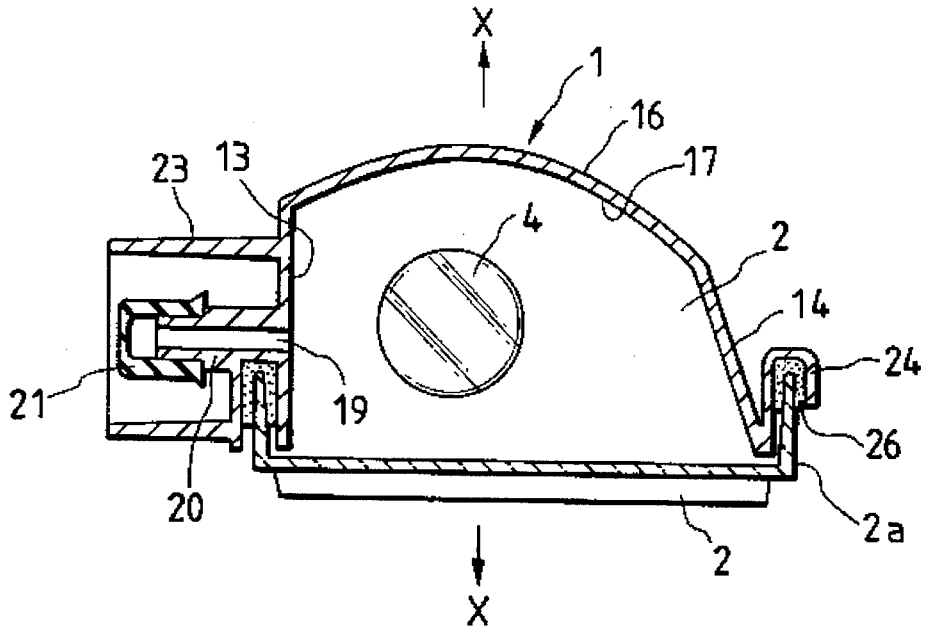
FIG. 3A is a sectional view of the lamp cut along a line A—A in FIG. 2A.
Figure 3B:
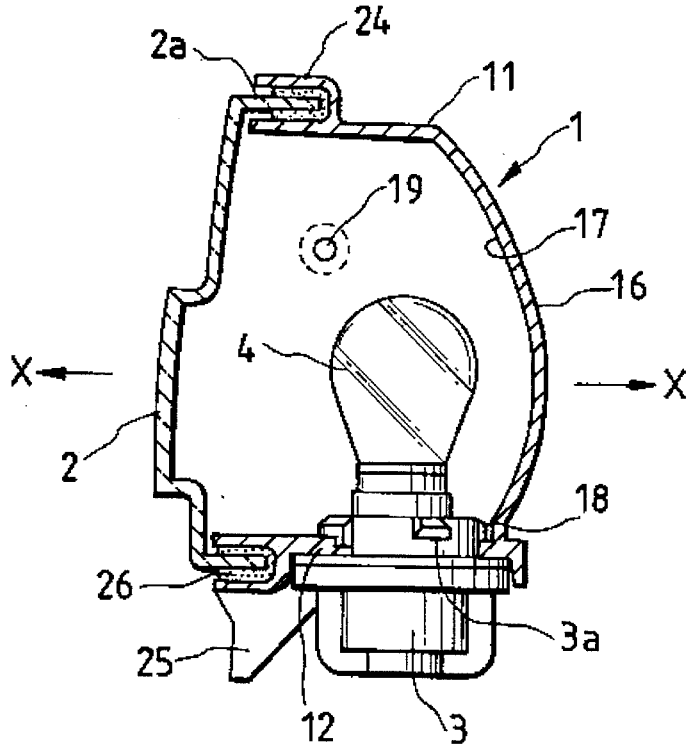
FIG. 3B is a sectional view of the lamp cut along a line B—B in FIG. 2A.

The present invention will now be described with reference to the accompanying drawings. FIG. 1 is a perspective view showing a vehicular lamp in the form of a back-up lamp for a motor vehicle, which lamp is constructed in accordance with the teachings of the present invention, FIG. 2A is a front view of the lamp shown in FIG. 1, FIG. 2B is a left side view of the lamp shown in FIG. 1, FIG. 3A is a sectional view of the lamp cut along a line A—A in FIG. 2A, and FIG. 3B is a sectional view of the lamp cut along a line B—B in FIG. 2A.

The present embodiment is an example where the present invention is applied to a right back-up lamp of an automobile. A cup-like lamp body 1 is rectangularly contoured and has a substantially square front shape. The lamp body 1 is provided with top, bottom, left and right peripheral walls 11, 12, 13 and 14, respectively, which form a rectangular front opening 15. The lamp body also has a rear wall 16 at a rear side of the peripheral walls 11–14. The peripheral walls 11–14 and the rear wall 16 are also formed as a single unit by resin molding. The rear wall 16 has a parabolic contour, a center point of which is offset to the left side to some extent. Inner surfaces of the rear wall 16 and the peripheral walls 11–14 are coated with aluminum or the like to constitute a reflecting surface. The parabolic inner surface of the rear wall 16 performs as an effective reflecting surface 17.

A circular bulb mounting hole 18 is formed in one of the peripheral walls (the bottom peripheral wall 12 in this embodiment), and bayonet grooves 18*a* of a known configuration are formed at plural locations on the circumferential edge of the bulb mounting hole 18. Further, a narrow vent 19 is formed in one of the other peripheral walls (the left peripheral wall 13 in this embodiment). A cylindrical member 20 connected to the vent 19 is integrally provided on the outer surface of the lamp body 1, and a cover tube 21 is fitted on the end of the cylindrical member 20. As shown in the figure, a bottom plate 22 and a top plate 23 protrude from the outer surface of the lamp body 1 at upper and lower portions of the cylindrical member 20 to surround same.

A seal groove 24 is formed along the entire circumferential edge of the front opening 15 of the lamp body 1, which groove opens toward the front of the lamp body 1. Further, a pair of brackets 25 are disposed at upper-right and lower-left edges of the lamp body 1, with which the lamp body is secured to the body of the vehicle.

A transparent outer lens 2 covers the front opening 15 of the lamp body 1. The outer lens 2 is mounted to the front opening 15 of the lamp body 1 by applying an adhesive 26 to the seal groove 24 and inserting a seal leg 2*a* integrally formed along the circumferential edge of the outer lens 2 into the seal groove 24. Thus, the outer lens 2 seals the front opening 15 of the lamp body 1. Although such is not shown in the drawings, lens steps are formed in a predetermined portion of the inner surface of the outer lens 2.

The bulb mounting hole 18 is engaged with a bulb socket 3 having a bayonet structure, whereby a plurality of bayonet pieces 3*a* are formed at the periphery of the bulb mounting hole 18. Thus, the bulb 4 is mounted inside the lamp body 1 via the socket 3. The bulb socket 3 is connected to a cord through which power is supplied from a voltage source (not shown).

With the back-up lamp thus constructed, one part of the light emitted from the bulb 4 supported on the bulb socket 3 radiates outward directly from the bulb through the outer lens 2, while the other part of the light emitted from the bulb 4 is reflected by a reflecting surface composed of the inner surfaces of the peripheral walls 11–14 of the lamp body 1 and the rear wall 16. The light reflected generally in the direction of the optical axis of the lamp is mainly light reflected by the inner surface of the rear wall 16, i.e., the effective reflecting surface 17. According to the present invention, since no bulb mounting hole or vent is formed in the effective reflecting surface 17, the entire area of the reflecting surface 17 can be designed to correspond to the area of the front opening 15 of the lamp body 1. Therefore, the reflection efficiency of the light emitted from the bulb is increased, thereby improving the lamp's light distribution characteristics so that a compact lamp having high luminosity can be obtained.

Further, when the lamp is viewed from the front of the vehicle while the lamp is off, no black shadow is seen within the lamp body when looking through the white transparent outer lens 2 because no bulb mounting hole or vent is present on the effective reflecting surface 17. Accordingly, a good outward appearance can be obtained.

Moreover, since the bulb socket 3 and the cylindrical member 20 of the vent 19 are formed on the peripheral walls, the lamp body can be designed with reduced dimensions in the front-rear direction thereof because the socket and the cylindrical member do not protrude from the rear wall. Accordingly, the lamp body can be made slim.

What is claimed is:

1. A vehicular lamp comprising:

a body comprising:

a peripheral wall forming a front opening, a bulb mounting hole being formed in said peripheral wall; and a parabolic rear wall integrally formed with said peripheral wall, said rear wall having a reflecting surface on an inner surface thereof;

a light bulb including electrodes at only one end thereof, said light bulb being mounted in said bulb mounting hole such that said electrodes are passed therethrough; and an outer lens fitted over said front opening of said body, wherein only one of said bulb mounting holes is provided for said light bulb.

2. The vehicular lamp according to claim 1, further comprising a vent formed on said peripheral wall.

3. The vehicular lamp according to claim 1 or 2, wherein said peripheral wall comprises top, bottom, left and right peripheral walls, said bulb mounting hole being formed in said bottom peripheral wall.

4. The vehicular lamp according to claim 2, wherein said peripheral wall comprises top, bottom, left and right peripheral walls, said vent being formed in said left peripheral wall.

5. The vehicular lamp according to claim 1, wherein said peripheral wall and said rear wall are formed as a single unit by resin molding.

6. The vehicular lamp according to claim 1, wherein a plurality of bayonet grooves are formed on a circumferential edge of said bulb mounting hole.

7. The vehicular lamp according to claim 2, further comprising a cylindrical member connected to said vent, said cylindrical member being integrally formed on an outer surface of said body.

8. The vehicular lamp according to claim 7, further comprising a cover tube fitted on said cylindrical member.

9. The vehicular lamp according to claim 7, further comprising a bottom plate and a top plate protruding from said outer surface of said body at upper and lower portions of said cylindrical member to surround said cylindrical member.

10. A vehicular lamp comprising: a lamp body having an effective reflecting surface at least at a part of an inner surface thereof, a bulb, including electrodes at only one end thereof, disposed inside said lamp body, a lens fitted over a front opening of said body, and a bulb mounting hole formed in said lamp body at a location other than on said effective reflecting surface for receiving said electrodes, wherein only one of said bulb mounting holes is provided for said light bulb.

11. The vehicular lamp according to claim 10, further comprising a vent formed on said lamp body at a location other than on said effective reflecting surface.

12. A vehicular lamp comprising:

a body comprising:

a peripheral wall forming a front opening, a bulb mounting hole being formed in said peripheral wall; and a parabolic rear wall integrally formed with said peripheral wall, said rear wall having a reflecting surface on an inner surface thereof;

a light bulb mounted in said bulb mounting hole; and an outer lens fitted over said front opening of said body wherein said peripheral wall comprises top, bottom, left and right peripheral walls, said bulb mounting hole being formed in said bottom peripheral wall.

13. A vehicular lamp comprising:

a body comprising:

a peripheral wall forming a front opening, a bulb mounting hole being formed in said peripheral wall; and a parabolic rear wall integrally formed with said peripheral wall, said rear wall having a reflecting surface on an inner surface thereof;

a light bulb mounted in said bulb mounting hole;

an outer lens fitted over said front opening of said body; and a vent formed on said peripheral wall, wherein said peripheral wall comprises top, bottom, left and right peripheral walls, said vent being formed in said left peripheral wall.

14. A vehicular lamp comprising:

a body comprising:

a peripheral wall forming a front opening, a bulb mounting hole being formed in said peripheral wall; and a parabolic rear wall integrally formed with said peripheral wall, said rear wall having a reflecting surface on an inner surface thereof;

a light bulb mounted in said bulb mounting hole; and an outer lens fitted over said front opening of said body, wherein a plurality of bayonet grooves are formed on a circumferential edge of said bulb mounting hole.

15. A vehicular lamp comprising:

a body comprising:

a peripheral wall forming a front opening, a bulb mounting hole being formed in said peripheral wall; and a parabolic rear wall integrally formed with said peripheral wall, said rear wall having a reflecting surface on an inner surface thereof;

a light bulb mounted in said bulb mounting hole;

an outer lens fitted over said front opening of said body;

a vent formed on said peripheral wall;

a cylindrical member connected to said vent, said cylindrical member being integrally formed on an outer surface of said body; and a bottom plate and a top plate protruding from said outer surface of said body at upper and lower portions of said cylindrical member to surround said cylindrical member.

* * * * *